US010648437B2

(12) United States Patent
Leblay et al.

(10) Patent No.: US 10,648,437 B2
(45) Date of Patent: May 12, 2020

(54) FUEL PUMP

(71) Applicant: DELPHI AUTOMOTIVE SYSTEMS LUXEMBOURG SA, Bascharage (LU)

(72) Inventors: Arnaud Leblay, Beuveille (FR); Adrien Bossi, Longwy (FR); Guy Hoffmann, Sandweiler (LU)

(73) Assignee: DELPHI AUTOMOTIVE SYSTEMS LUXEMBOURG SA, Bascharage (LU)

( * ) Notice: Subject to any disclaimer, the term of this patent is extended or adjusted under 35 U.S.C. 154(b) by 0 days.

(21) Appl. No.: 16/300,343

(22) PCT Filed: May 4, 2017

(86) PCT No.: PCT/EP2017/060723
§ 371 (c)(1),
(2) Date: Nov. 9, 2018

(87) PCT Pub. No.: WO2017/194389
PCT Pub. Date: Nov. 16, 2017

(65) Prior Publication Data

US 2019/0145365 A1 May 16, 2019

(30) Foreign Application Priority Data

May 10, 2016 (GB) ..... 1608141.6

(51) Int. Cl.
*F01L 1/00* (2006.01)
*F02M 59/02* (2006.01)
(Continued)

(52) U.S. Cl.
CPC ..... *F02M 59/022* (2013.01); *F02M 37/0023* (2013.01); *F02M 59/20* (2013.01); *F02M 59/205* (2013.01); *F02M 59/34* (2013.01); *F02M 59/46* (2013.01); *F02M 59/464* (2013.01); *F02M 63/005* (2013.01); *F02M 63/0042* (2013.01); *F04B 1/053* (2013.01); *F04B 1/08* (2013.01); *F04B 7/02* (2013.01); *F04B 9/042* (2013.01); *F04B 49/08* (2013.01); *F04B 49/22* (2013.01); *F04B 53/16* (2013.01);
(Continued)

(58) Field of Classification Search
CPC ..... F01L 2001/34426; F01L 2001/3443; F01L 2001/34433
USPC ..... 123/90.1, 90.12, 90.14
See application file for complete search history.

(56) References Cited

U.S. PATENT DOCUMENTS 6,176,225 B1 * 1/2001 Sams ..... F02B 43/00 123/514
10,385,795 B2 * 8/2019 Dudar ..... F02B 43/00
(Continued)

FOREIGN PATENT DOCUMENTS

DE 102007022219 A1 11/2008
JP 2010163888 A 7/2010
WO 2012089511 A1 7/2012

*Primary Examiner* — John Kwon
(74) *Attorney, Agent, or Firm* — Joshua M. Haines

(57) ABSTRACT

A fuel pump includes a mechanical regulating valve arranged in a pump body which modulates the pressure in a high pressure space so that the pressure matches the engine demand. Modulation by the regulating valve requires adjustment of the inlet fuel quantity, adjustment of the volume of the high pressure space, and control of a return fluid communication enabling fuel to exit the high pressure reservoir.

16 Claims, 6 Drawing Sheets

(51) Int. Cl.

| | |
|---|---|
| ***F02M 59/46*** | (2006.01) |
| ***F02M 37/00*** | (2006.01) |
| ***F04B 9/04*** | (2006.01) |
| ***F04B 49/22*** | (2006.01) |
| ***F02M 63/00*** | (2006.01) |
| ***F04B 1/08*** | (2006.01) |
| ***F04B 1/053*** | (2020.01) |
| ***F02M 59/34*** | (2006.01) |
| ***F04B 49/08*** | (2006.01) |
| ***F04B 53/16*** | (2006.01) |
| ***F02M 59/20*** | (2006.01) |
| ***F04B 7/02*** | (2006.01) |
| *F02D 1/00* | (2006.01) |
| *F04B 17/05* | (2006.01) |

(52) U.S. Cl.

CPC ..... *F02D 2001/0085* (2013.01); *F04B 17/05* (2013.01); *F04B 2203/0604* (2013.01); *F04B 2205/03* (2013.01)

(56) References Cited

U.S. PATENT DOCUMENTS

| | | | | |
|---|---|---|---|---|
| 2009/0097997 | A1 | 4/2009 | Suzuki et al. | |
| 2011/0000182 | A1* | 1/2011 | Lasker | F02C 1/04 60/39.24 |
| 2011/0114064 | A1 | 5/2011 | Akita et al. | |
| 2011/0125387 | A1 | 5/2011 | Suzuki et al. | |
| 2012/0118053 | A1* | 5/2012 | Serra | F02D 41/221 73/114.51 |
| 2012/0123703 | A1* | 5/2012 | Serra | F02D 41/2432 702/47 |

* cited by examiner

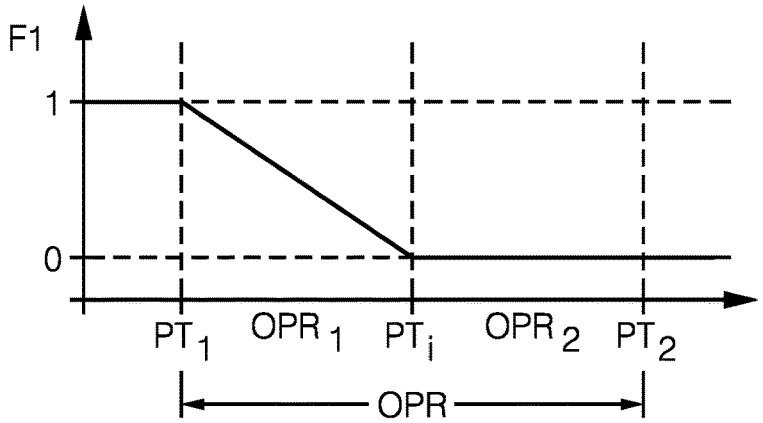
FIG. 2
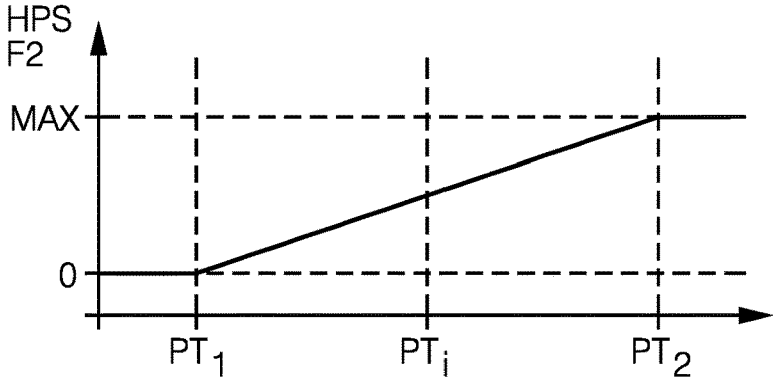
FIG. 3
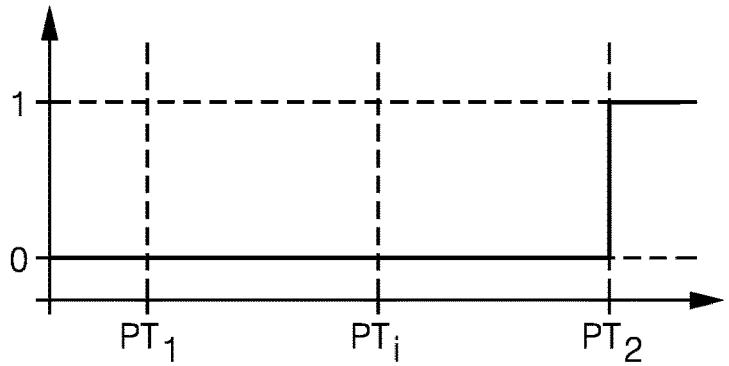
FIG. 4
| | $PT_1$ | | $PT_i$ | $PT_2$ |
|---|---|---|---|---|
| F1 | 1 | | 0 | 0 |
| HPS F2 | 0 | | | 1 |
| F3 | 0 | 0 | 0 | 1 |
| REGULATION | 0 | 1 | 1 | 0 |
FIG. 5

FUEL PUMP

CROSS REFERENCE TO RELATED APPLICATIONS

This application is a national stage application under 35 USC 371 of PCT Application No. PCT/EP2017/060723 having an international filing date of May 4, 2017, which is designated in the United States and which claimed the benefit of GB Patent Application No. 1608141.6 filed on May 10, 2016, the entire disclosures of each are hereby incorporated by reference in their entirety.

TECHNICAL FIELD

The present invention relates to a self-regulated fuel pump.

BACKGROUND OF THE INVENTION

Fuel injection equipment of internal combustion engine comprise high pressure pump fluidly connected between a low pressure fuel system such as a transfer pump immersed in a fuel tank, and a high pressure system comprising a reservoir, such as a well-known common-rail, in which is stored pressurized fuel prior to be delivered and sprayed by fuel injectors into compression chambers of the engine.

A command unit receiving a plurality of information signals from the engine and the vehicle generates command signals for adjusting operational parameters of the injection equipment to the engine demand.

For instance, to match the engine demand for speed, acceleration or deceleration of the vehicle, the quantity and pressure of fuel to be sprayed is computed by the command unit which in turn generates orders commanding each component of the injection equipment, transfer pump, high pressure pump, injectors, an operational behavior adapted to said engine demand.

In gasoline engines, said quantity and volume of pressurized fuel is regulated by the command unit via electrical means such as an electrical pump or an electrical spill valve. In addition to the cost incurred because of said electrical actuators, the acoustic noise generated by the motions commanded has become a major issue.

SUMMARY OF THE INVENTION

Accordingly, it is an object of the present invention to resolve the above mentioned problems in providing a self-regulated fuel pump assembly of a fuel injection system of an internal combustion engine, the pump assembly being adapted to be arranged between a low pressure tank and a high pressure reservoir, the pump comprising a pump body defining and inlet fluid communication controlled by an inlet valve for enabling in use, an inlet fuel quantity to enter a compression chamber, wherein said fuel is pressurized by a piston varying the volume of said compression chamber and, wherefrom pressurized fuel is expelled and delivered into a high pressure space, comprising the high pressure reservoir, via an outlet fluid communication controlled by an outlet valve.

Advantageously, the fuel pump further comprises a mechanical regulating valve arranged in the pump body and adapted to modulate, in use, the pressure in a high pressure space so that, said pressure matches the engine demand, said modulation requiring adjustment of the inlet fuel quantity, adjustment of the volume of the high pressure space wherein is stored the pressurized fuel and, control of a return fluid communication enabling fuel to exit the high pressure reservoir.

Also, in use, the mechanical regulating valve is active within an operational pressure range extending between a first pressure threshold below which the inlet fluid communication is fully open and, a second pressure threshold above which opens the return fluid communication.

Also, in use, throughout the operational pressure range the pressure in the high pressure reservoir is adjusted to match the engine demand by adjusting the volume of the high pressure space as a function of the pressure in said high pressure space.

Also, in use, when the pressure in the high pressure space is within a lower sub-range closer to the first pressure threshold of the operational pressure range, the pressure in the high pressure reservoir is further adjusted to the engine demand by restricting the inlet fluid communication thus decreasing the inlet quantity of fuel entering in the compression chamber.

Also, the inlet fluid communication is continuously varied within said lower sub-range.

Also, in use, when the pressure in the high pressure space is within a higher sub-range closer to the second pressure threshold of the operational pressure range, the pressure in the high pressure reservoir is further adjusted to match the engine demand by closing the inlet fluid communication thus preventing fuel entry in the compression chamber.

Also, the lower sub-range extends from the first pressure threshold to an intermediate pressure threshold and, the higher sub-range extends from said intermediate pressure threshold to the second pressure threshold.

Also, the mechanical regulating valve comprises a spool valve member slidably arranged in a valve bore provided in the pump body, said arrangement controlling the inlet fluid communication, the volume of the high pressure space and, the return fluid communication.

Also, the mechanical regulating valve further comprises a valve spring biasing the spool valve member toward a first extreme position where the inlet fluid communication is fully open and the return fluid communication is closed, and wherein in use, the pressure in the high pressure space bias the spool valve member toward a second extreme position where the inlet fluid communication is closed and the return fluid communication is open, the biasing force of the spring being opposed to the biasing force of the outlet pressure.

Also, the spool valve member has a cylindrical lateral face extending from a front end, or outlet end, to a back end, or inlet end, said front end being provided with a closing member adapted to sealingly seat against a seating face of the pump body, said seating face surrounding a relief opening of the return fluid communication and wherein, when the spool valve member is in the first extreme position the closing member sealingly seats on the seating face closing said relief opening.

Also, the return fluid communication is further provided with a rear opening defined at an end of a spill channel arranged in the spool valve member the opening entry of said spill channel being in the front end of the spool valve member, in the close vicinity to the closing member and wherein, said rear opening only opens when the spool valve member is in the second extreme position enabling fuel to return from the relief chamber to the low pressure inlet.

Also, the end of said spill channel opens in the lateral face of the spool valve member, the opening of said end being closed by the face of the valve bore against which complementary slides the lateral face of the spool valve member and wherein, the rear opening of the return fluid communication only opens when the spool valve member is in the second extreme position, the rear end of the spill channel facing the opening of the return conduit.

Also, the spool valve member further comprises an inner inlet channel extending inside the spool valve member from the back end toward an opening in the lateral face of the spool valve member and wherein, the controlled inlet channel wherein is arranged the inlet valve opens at one end in the compression chamber and, at the opposite end in the valve bore face via an inlet aperture, the inlet fluid communication being open when said opening of the inner inlet channel faces said inlet aperture.

Also, said opening of the inner inlet channel is defined in an annular inlet groove provided in the lateral face of the spool member and wherein, when being in the first extreme position of the spool valve member, the inlet aperture faces said inlet groove.

Also, when the pressure in the high pressure space varies within the lower sub-range of the operational pressure range, the spool valve member slides in the valve bore, the cylindrical lateral face of the spool member partially covering the inlet aperture of the controlled inlet channel, restricting the inlet fluid communication.

Also, when the pressure in the high pressure space increases within the higher sub-range of the operational pressure range, the spool valve member slides in the valve bore the cylindrical lateral face totally covering the inlet aperture of the controlled inlet channel thus closing the inlet fluid communication.

Also, when the pressure in the high pressure space rises, the volume of the high pressure space increases by the additional space of a relief chamber comprised between the front end of the spool valve member and the seating face of the pump body.

Also, the inlet valve is a one-way check valve forbidding to fuel pressurized in the compression chamber to flow back toward the inlet and wherein, the outlet valve is another one-way check valve forbidding high pressure fuel contained in the high pressure space to flow back to the compression chamber.

BRIEF DESCRIPTION OF THE DRAWINGS

The present invention is now described by way of example with reference to the accompanying drawings in which:

FIG. 2 is a plot of evolution of an inlet fluid communication of the equipment of FIG. 1 as a function of pressure.

FIG. 3 is a plot of evolution of the volume of a high pressure space of the equipment of FIG. 1 as a function of pressure.

FIG. 4 is a plot of evolution of a return fluid communication of the equipment of FIG. 1 as a function of pressure.

FIG. 5 is a table summarizing the domain in which regulation of the pressure in the high pressure space occurs for the equipment of FIG. 1.

DESCRIPTION OF THE PREFERRED EMBODIMENTS

In reference to the figures is described a self-regulated high pressure pump assembly 10 adapted to be arranged in fluid communication in an injection fuel equipment, not represented. Upstream the pump 10 is a low pressure system comprising a low pressure fuel tank 12 and a transfer pump and, downstream the pump 10 is a high pressure system for storing and delivering the pressurized fuel, said system typically comprising a high pressure reservoir, often referred as a "common rail" to which are fluidly connected a plurality of fuel injectors.

Figure 1:
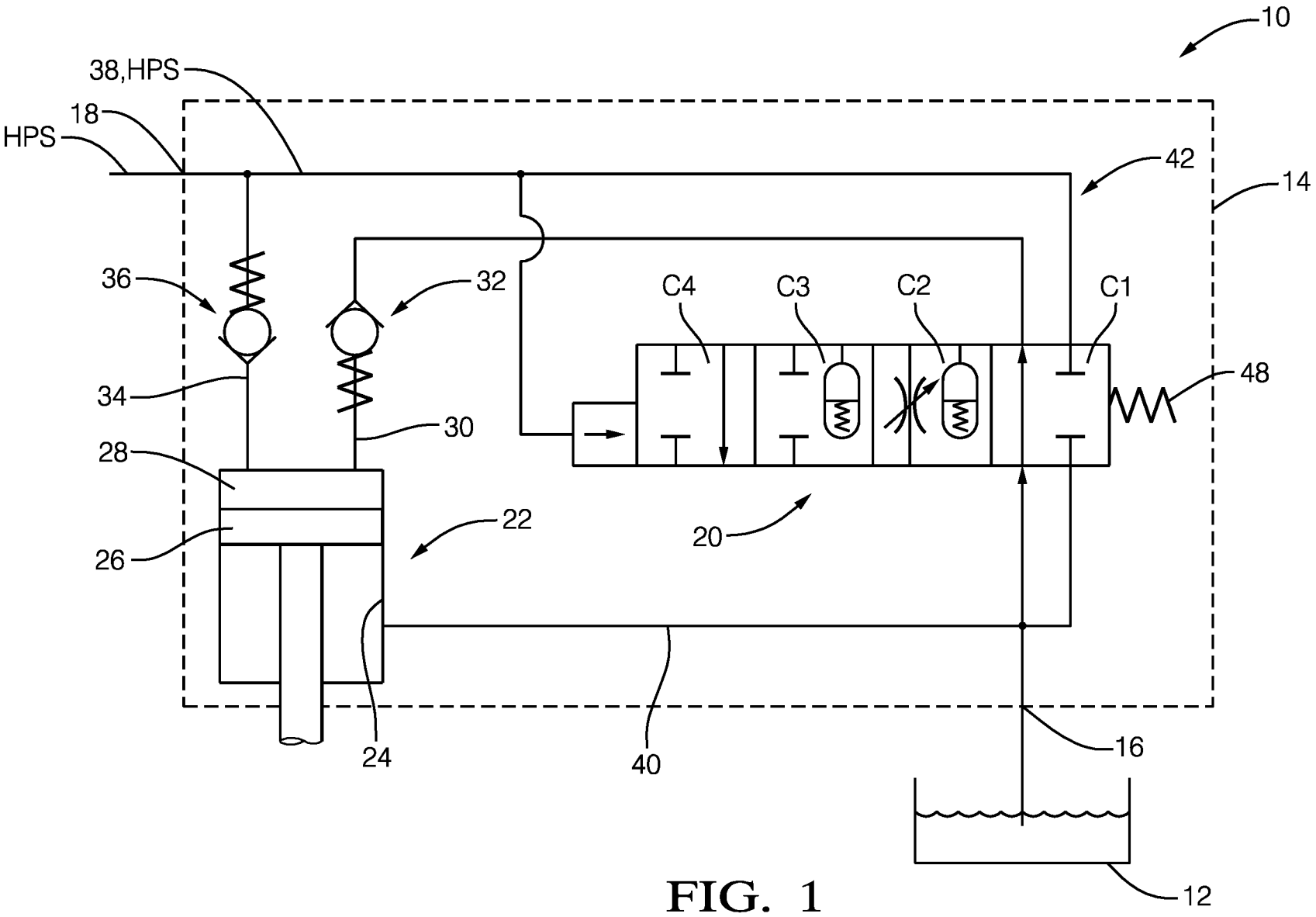
FIG. 1 is a schematic hydraulic of a fuel injection system as per the invention.

The general hydraulic diagram of FIG. 1 enables to schematically identify the functions fulfilled by the self-regulated pump 10 and its components.

The pump 10 has a pump body 14 provided with a pump inlet 16 and a pump outlet 18 and, between said inlet and outlet, are arranged a regulation unit 20 and a pressurizing unit 22.

The pressurizing unit 22 comprises a bore 24 in which a plunger 26, forming piston, is adapted to reciprocal translations along a pumping axis X performing therein a pumping cycle between a bottom dead centre (BDC) position and a top dead centre (TDC) position. A compression chamber 28, which inner volume is varied during said pumping cycle, is defined between an end of the bore 24 and the piston 26.

Fuel at low pressure, few bars for instance, enters the pump body 14 via the pump inlet 16, flows through the regulation unit 20 that is described afterward and, enters the compression chamber 28 via a controlled inlet channel 30 controlled by an inlet valve 32. Once pressurized, for instance at 100 bars, the fuel exits the compression chamber 28 via a controlled outlet channel 34 controlled by an outlet valve 36. Said controlled channel 34 opens in a final outlet channel 38 extending toward the pump outlet 18 adapted to be connected to a pipe, not represented, connecting to the high pressure reservoir. Said final outlet channel 38 is part of a high pressure space HPS comprising the high pressure reservoir, the connecting pipe and this final outlet channel 38 integral to the pump body 14.

Both inlet and outlet valves 32, 36, are non-return check valves wherein a ball, or alternatively other known type of valve member, biased by a coil spring in abutment against a seating face close an orifice. The coil spring have low stiffness limited to maintaining the ball in closed position against their seating face when the ball is not subject to any counter force. The two check-valves 32, 36, are arranged to allow fuel flow in a one-way direction globally from the inlet 16 to the outlet 18 and, to forbid counter flow. Between the lateral face of the piston 26 and the bore 24 is kept a functional clearance through which, in use, fuel leaks from the compression chamber 28, said leaks being collected into a return leak channel 40 flowing back toward the pump inlet 16.

The regulation unit 20 is arranged in the pump body 14 in fluid communication between the pump inlet 16 and controlled inlet channel 30. It aims at regulating the pressure in the high pressure space HPS by fulfilling functions further detailed afterward.

Said regulation unit 20 takes the form of a mechanically regulated valve 42, represented on the FIGS. 6 to 11, having a spool valve member 44 slidably adjusted in a valve bore 46 and therein adapted to translate between a first extreme position P1 and, a second extreme position P2. The spool valve member 44 is urged toward the first extreme position P1 by a valve spring 48 pushing on an inlet end 50 of the spool member, FIG. 8, and, in the opposite direction the spool 44 is urged toward the second extreme position P2, FIG. 11, by the pressure in the final outlet channel 38, some pressurized fuel being deviated from said final channel 38 to push onto an outlet end 52 of the spool member.

Below a first pressure threshold PT1 in the high pressure space HPS, the force of the valve spring 48 overcomes the opposite force of the pressure and, the spool member 44 remains in the first extreme position P1.

When the pressure in the high pressure space HPS overcomes the first threshold PT1, the force urged on the outlet end 52 of the spool member surpasses the spring force and the spool member 44 lifts off the first extreme position P1.

When the pressure in the high pressure space HPS continues to rise and reaches a second pressure threshold PT2, the force urged by said pressure overcomes the spring force that is fully compressed and, the spool member 44 is pushed to the second extreme position P2.

The first PT1 and second PT2 pressure thresholds define an operational pressure range OPR of the regulation unit 20. Conclusive tests have been conducted where said range OPR extended between 50 and 100 bars.

The functions fulfilled by the regulation unit 20 are now described in reference to FIG. 1 and to FIGS. 2 to 5.

Firstly, the regulation unit 20 controls the pressure in the high pressure space HPS by controlling an inlet fluid communication F1 enabling access of inlet fuel to the compression chamber 28. Indeed, between the pump inlet 16 and the controlled inlet channel 30, an inlet aperture 54 is defined as the opening controlled inlet channel 30 into the valve bore 46. The movements of the spool member 44 restrict said inlet fluid communication F1 by partially closing said inlet aperture 54 from a non-restricted state or, fully open state, when the spool member 44 is in the first extreme position P1 to, a closed state forbidding any entry of fuel into the compression chamber 28 when the spool member 44 reaches an intermediate position Pi, the pressure in the high pressure space HPS being at an intermediate pressure threshold PTi inferior to the second threshold PT2. Above said intermediate position Pi the inlet fluid communication F1 remains closed.

In FIG. 1 the spool member 44 is divided in four cells referenced from right to left C1 to C4. This first function is sketched in FIG. 1 by the four cells where in cell C1 the inlet is fully open, in the second cell C2 the inlet is limited, while it is fully closed in the third cell C3 and remains closed to the final cell C4.

FIG. 2 illustrates this first function. It is an X-Y graph plotting the evolution of the inlet fluid communication F1 controlling the inlet quantity of fuel admitted in the compression chamber as a function of the pressure in the high pressure space HPS.

When the outlet pressure, on the horizontal X axis, is below the first pressure threshold PT1, the inlet fluid communication F1 is fully open and the inlet quantity is maximum, this being symbolized on the Y axis by the number "1".

When the outlet pressure is between the first PT1 and the intermediate PTi pressure thresholds the inlet fluid communication F1 restricts and the inlet quantity decreases. The plot of FIG. 2 is a straight line for this portion of the curve while in reality the function may show more roundness.

Above the intermediate pressure threshold PTi, the inlet fluid communication F1 fully closes and no more fuel is admitted the compression chamber, this state being symbolized on the Y axis by number "0". Considering the embodiment detailed below, said closure of the first fluid communication F1 is indeed limited to some fuel leakages.

Secondly, the regulation unit 20 further controls the pressure in the high pressure space HPS by increasing the volume of said high pressure space HPS in opening a second fluid communication F2 to a relief chamber 56 which inner volume adds up to the volume of the high pressure space HPS.

Thirdly, the regulation unit 20 further controls the pressure in the high pressure space HPS since, the volume of said relief chamber 56 permanently self-adapts to the pressure in the final outlet channel 38, the volume of the relief chamber ranging from null when the second fluid communication F2 is closed, the spool member 44 being in the first extreme position P1 to, a maximum volume when the spool 44 is in the second extreme position P2. This auto-regulation, or self-adaptation, of the volume of the high pressure space HPS to the pressure of the high pressure space HPS acts as a damper enabling to amortize pressure waves propagating in the pressurized fuel contained in the high pressure space HPS.

FIG. 3 illustrates the second and third functions in another X-Y graph plot of the evolution of the volume of the high pressure space HPS as a function of the pressure in the high pressure space HPS.

As long as the outlet pressure is below the first pressure threshold PT1, the second fluid communication F2 is closed, this being symbolized by number "0" on the Y axis and, the volume of the high pressure space HPS is minimal.

When the outlet pressure is within the operational pressure range OPR, between the first PT1 and the second PT2 pressure thresholds, the second fluid communication F2 is open and the volume of the relief chamber 56 regularly increases up to a maximum, "MAX" on the Y axis, when pressure in the high pressure space HPS rises to the second pressure threshold PT2, the spool member 44 reaching the second extreme position P2.

Fourthly, the regulation unit 20 finally controls the pressure in the high pressure space HPS by opening a return fluid communication F3 when the spool member 44 reaches the second extreme position P2. Indeed, the regulation unit 20 further defines a spill channel 58 enabling exit of excess fuel contained in the relief chamber 56 and therefore in the high pressure space HPS. In the second extreme position P2 said spill channel 58 is open, otherwise it is closed.

The second, third and fourth functions are depicted on FIG. 1 throughout the cells C1-C4 of the spool, the return fluid communication F3 only opening in the final cell C4 and, between the first C1 and fourth C4 cells the second fluid communication F2 opens the high pressure space HPS to the relief chamber 56 which volumes varies and damps the pressure pulsations propagating within the pressurized fuel.

FIG. 4 illustrates the fourth function in yet another X-Y graph plotting the evolution of the return fluid communication F3 as a function of the pressure in the high pressure space HPS.

As long as the pressure in the high pressure space HPS is below the second pressure threshold PT2, the return fluid communication F3 is closed, "0" on the Y axis and, when the pressure in the high pressure space HPS reaches the second pressure threshold PT2 said return fluid communications F3 opens, symbolized by number "1" on the Y axis.

Regulation of the pressure in the high pressure space HPS is achieved by combining all the functions. This is summarized in FIG. 5 that is a table in which:

the first line is the pressure in the high pressure space HPS as it is scaled in X axis of the plots of FIGS. 2, 3 and 4;

The second line is the state of the inlet fluid communication F1 as plotted in FIG. 2;

the third line is the state of the second fluid communication and the volume of the relief chamber 56 as plotted in FIG. 3;

the fourth line is the state of the return fluid communication F3 as plotted in FIG. 4 and, the bottom line is the state of regulation of the pressure in the high pressure space HPS where, outside the operational pressure range OPR there is no regulation provided since none of the parameters varies but, when return fluid communication F3 opens the actual pressure in the high pressure space HPS cannot increase any more.

Below the first pressure threshold PT1 the inlet fluid communication F1 is permanently fully open, the second fluid communication F2 is permanently closed and the return fluid communication is also permanently closed.

Above the second pressure threshold PT2 the inlet fluid communication F1 is permanently closed, the second fluid communication F2 is open and the volume of the relief chamber 56 is maximum and, the return fluid communication F3 is open.

Within the operational pressure range OPR, in a lower sub-range OPR1 between the first pressure threshold PT1 and the intermediate pressure threshold PTi, the pressure in the high pressure space HPS is regulated by adjusting the inlet fluid communication F1 thus adjusting the inlet flow as a function of the pressure in the high pressure space HPS, and also by increasing the volume of the relief chamber 56 also as a function of the pressure in the high pressure space HPS. These two parameters combine and tend to regulate the pressure in the high pressure space HPS by lowering said pressure when indeed it is trying to increase.

When the pressure in the high pressure space HPS increases into a higher sub-range OPR2 of the operational pressure range OPR, between the intermediate pressure threshold PTi and the second pressure threshold PT2, the pressure in the high pressure space HPS is regulated by closing the inlet fluid communication F1 and jointly increasing the volume of relief chamber 56 still as a function of the pressure in the high pressure space HPS. This continuous increase in relief chamber volume pursues the pressure regulation by tending lowering said pressure when indeed said pressure continues to rise.

A non-limiting embodiment is now described more in detailed in reference to FIGS. 6 to 15.

Figure 7:
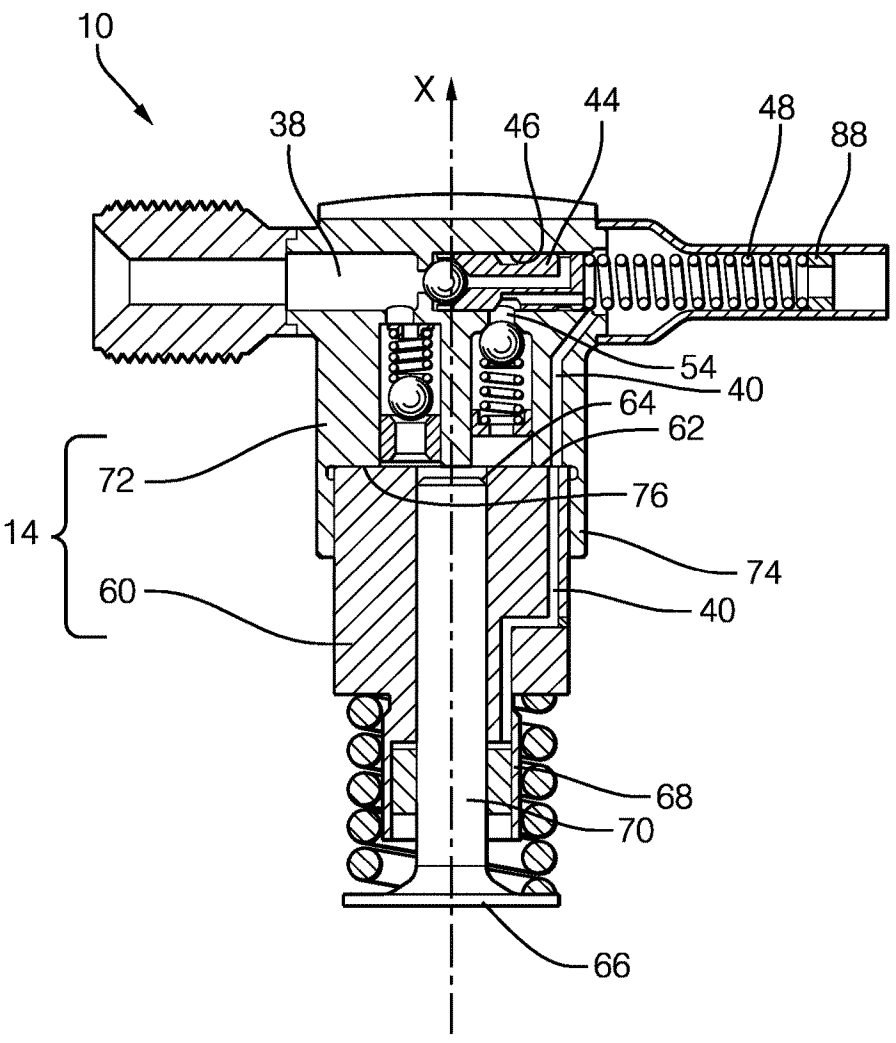
FIGS. 6 and 7 are axial sections of a pump as per a preferred embodiment of the invention, FIG. 6 representing the pump in BDT and FIG. 7 in TDC.
Figure 6:
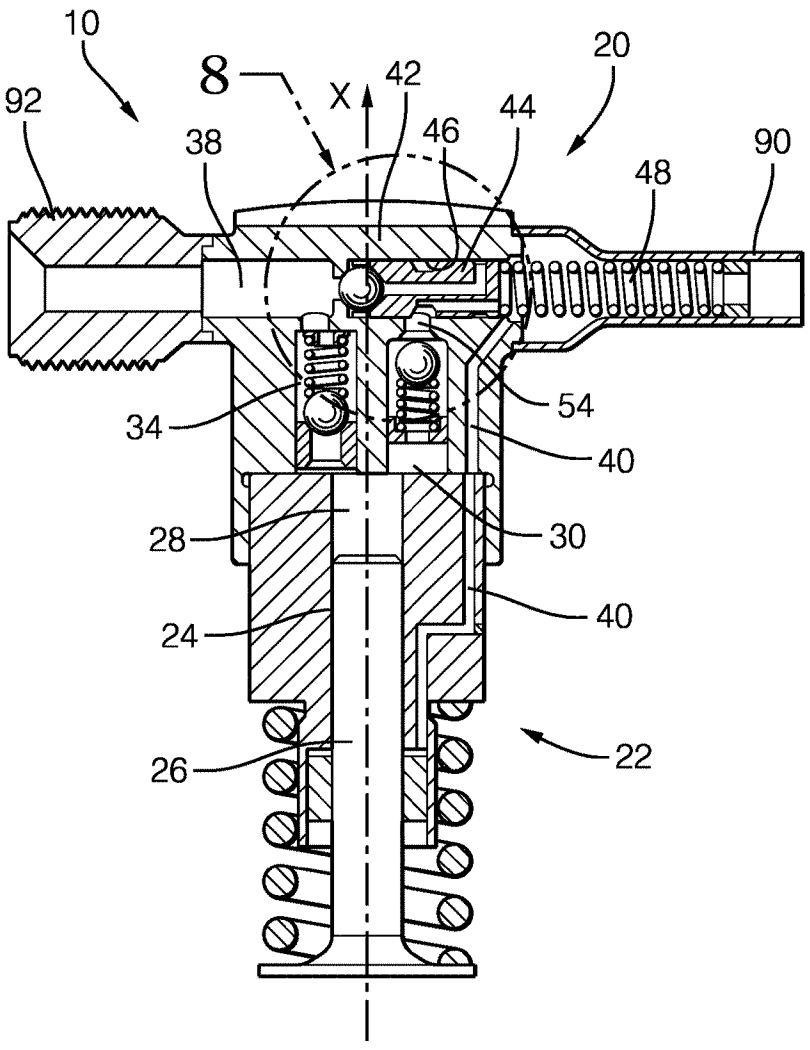

The pump assembly 10 is represented in BDC in FIG. 6 and in TDC in FIG. 7, the pressurizing unit 22 being on the bottom part of the figures while the regulation unit 20 is fixed on the top of it.

The pressurizing unit 22 comprises a cylindrical body 60 having a large top portion and a downwardly extending narrower turret. The bore 24, provided in said pressurizing body 22, extends along the pumping axis X both through the large portion and through the turret, the bore 24 opening in the upper face 62 of the pressurizing body as well as at the lower end of the turret. In the upper face 62, the bore opens in a shallow recess forming a gallery 64 enlarging said opening of the bore. The top part of the plunger 26 is slidably arranged in the bore 24 while the bottom end downwardly protrudes out of the pressurizing body 60 toward an end provided with a cam follower 66, or slider, adapted to follow the profile of a cam, not represented. In the turret is arranged a lip seal 68 preventing fuel leaks to exit and flow out of the pump where oil lubricates the cam area. Said leaks, as mentioned previously, downwardly flow between the plunger 26 and the bore 24 and are collected in the leak return channel 40 provided in the pressurizing body 60 that redirect in the upward direction said fuel leaks toward the pump inlet 16. As visible on the figures, the leak return channel 40 comprises a lower portion in the pressurizing body 60 and an upper portion above. A main valve spring 70 engaged around the turret and compressed between a face of the top portion of the body 60 and the cam follower 66 urges the plunger 26 toward the BDC position and ensures that the cam follower remains in contact with the cam. In use, when the cam rotates it imparts to the plunger 26, via the cam follower 66 the pumping cycle displacements between BDC and TDC.

The regulation unit 20 also comprises a body 72 provided on its part with a recess defining a cylindrical lateral wall 74 and a bottom face 76, said recess being complementary adjusted to receive the pressurizing body 60 which is engaged and fixed in said recess. The upper face 62 of the pressurizing body is sealingly compressed against the bottom face 76 of the recess and, the lateral male cylindrical face of the pressurizing body lies against the lateral female inner face of the wall 74. Fixation of the bodies 60, 72, can be done by welding or screwing, provided that complementary threads are provided on the male and female cylindrical faces of the bodies. The pump body 14 is the integral assembly of the pressurizing body 60 and of the regulation body 72. The central area of the bottom face 76 of the recess, area that is right above the top opening of the bore 24 and above the gallery 64 forms a ceiling 78 for the compression chamber 28. The peripheral area surrounding said ceiling 78 is compressed in surface contact against the complementary peripheral area of the upper face 62 of the pressurizing body ensuring sealing of the area.

As visible on the figure, and following the non-limiting and non-binding top-down orientation presented, the regulation body 72 is further provided, in its upper region, with the valve bore 46 and with the final outlet channel 38 that are horizontally aligned, the valve bore 46 opening on the lateral outer face of the body 72, right of the figure, and the final outlet channel 38 opening at the opposite, left of the figure. The second fluid communication F2 takes the form of an opening 80 joining the right end of the final outlet channel 38 to left end of the valve bore 46. Furthermore, said opening, or relief opening 80, is surrounded by a seating face 82 that can be rounded or conical and which is provided on the side of the valve bore 46.

The regulating body 72 is further provided with the controlled inlet channel 30, right of the figure, and with the controlled outlet channel 34, left of the figure, that are both vertically upwardly extend from the ceiling 78 of the compression chamber.

The controlled inlet channel 30 opens in the valve bore 46 through the inlet aperture 54 that joins the top end of the controlled inlet channel 30 to the horizontal lateral face of the valve bore 46. At the end of the controlled inlet channel 30, the inlet aperture 54 is surrounded by the seating face previously mentioned when describing the non-return inlet check valve 32. Also, as already mentioned, in the controlled inlet channel 30 is arranged said inlet valve 32 which ball is upwardly biased by the inlet valve coil spring against said seating face, thus closing the inlet aperture 54. An annular member, press-fitted in the lower region of the controlled inlet channel 30 forms an annular shoulder face against which the bottom end of the spring can bear and be compressed.

The controlled outlet channel 34 opens in the final outlet channel 38, via an aperture 84 that vertically joins the top end of the controlled outlet channel 34 to the horizontal lateral face of the final outlet channel 38. Also, as already mentioned, in the controlled outlet channel 34 is arranged said outlet valve 36 which ball is downwardly biased by the outlet valve coil spring against a seating face provided with another annular member press-fitted in the lower region of the controlled outlet channel 34. In the upper region, in the vicinity to said aperture 84, the upper end outlet valve coil spring bears against a washer member forming another annular shoulder face against which said spring is compressed.

The arrangement of the inlet 32 and outlet 36 check valves is done to only enable fuel flow from the inlet toward the compression chamber and, from said compression chamber toward the outlet. The reverse flow is prevented by the check valves. The two coil springs have low stiffness just enabling to maintain the ball in place against their seating face but, as soon as fuel pushes the ball in the opening direction, said pushing force overcomes the spring force that further compresses, opening said fuel passage.

In FIG. 6 the piston 26 is in BDC and inlet flow enters the compression chamber. The inlet valve 32 is open while the outlet valve 36 is closed.

In FIG. 7 the piston has moved upwardly to the TDC, the fuel in the compression chamber is pressurized, the inlet valve is closed and the outlet valve is open.

In the valve bore 46 is slidably arranged the spool valve member 44 provided on its outlet end 52, left end on the figure, with a ball 86 forming a closing member adapted to sealingly bear against the seating face 82, thus closing the second fluid communication F2. On the inlet end 50, right end on the figure, the valve spring 48 pushes the spool member 44 in said closing position of the second fluid communication F2. The valve spring 48 is compressed between said inlet end 50 of the spool member 44 and an annular member 88 press-fitted in an inlet pipe 90 connected to the pump inlet 16.

Also, as previously mentioned, the upper portion of the leak return channel 40 extends in the regulation body 72 from a connection in the lower portion to an outer opening arranged of the pump inlet opening within this inlet pipe 90. Therefore, fuel leakage during operation flows from the compression chamber around the plunger 26, then it reaches the return leak channel 40 prior to exit in the inlet pipe 90 where said leaks merges with the low pressure fuel inlet entering the pump.

The regulation body 72 is further provided with a tubular outlet connection member 92 fixed around the pump outlet 18 at the opening end, left end of the figure, of the final outlet channel 38. The connection member 92 is threaded to enable tightening of the connecting pipe, not represented that, along with the high pressure reservoir is part of the high pressure space HPS.

The regulating valve 42 and the spool member 44 are now further described in reference to the FIGS. 8 to 11.

As represented on said figures, the spool member 44 is a cylindrical member horizontally adjusted to slide within the valve bore 46. The opening end of the bore 46 in the peripheral face of the regulation body 72 is slightly enlarged, the leak return channel 40 opening in said enlarged entry 94, further motivation for having said enlarged entry 94 of the bore being explained afterward.

The spool member 44 extends from its inlet end 50, right end of the figure, to its outlet end 52, left end, wherein is crimped the ball 86 forming the closing member of the second fluid communication F2. About half way between its inlet and outlet ends, the spool member 44 is further provided with a surrounding annular inlet groove 96 opening in the outer cylindrical face of the spool.

The spool member 44 is further provided with an inner inlet channel 98 extending from the inlet end 50 of the spool member to an opening provided in a side face of the inlet groove 96.

Furthermore, the spill channel 58 is arranged within the spool member 44, opening in the outlet end 52, beside the ball 86, and extending to a rear end opening 100 that is arranged in the cylindrical peripheral face of the spool member, in the close vicinity to the inlet end 50. As visible on the figure, said spill channel 58 comprises a front portion that surrounds the ball 86, then a straight axial portion and finally a radial portion leading to said rear end opening 100. Alternatively, the inner inlet channel 98 could only comprise one straight portion drilled angularly from the rear end opening 100 to the outlet end 52 of the spool member.

Figure 8:
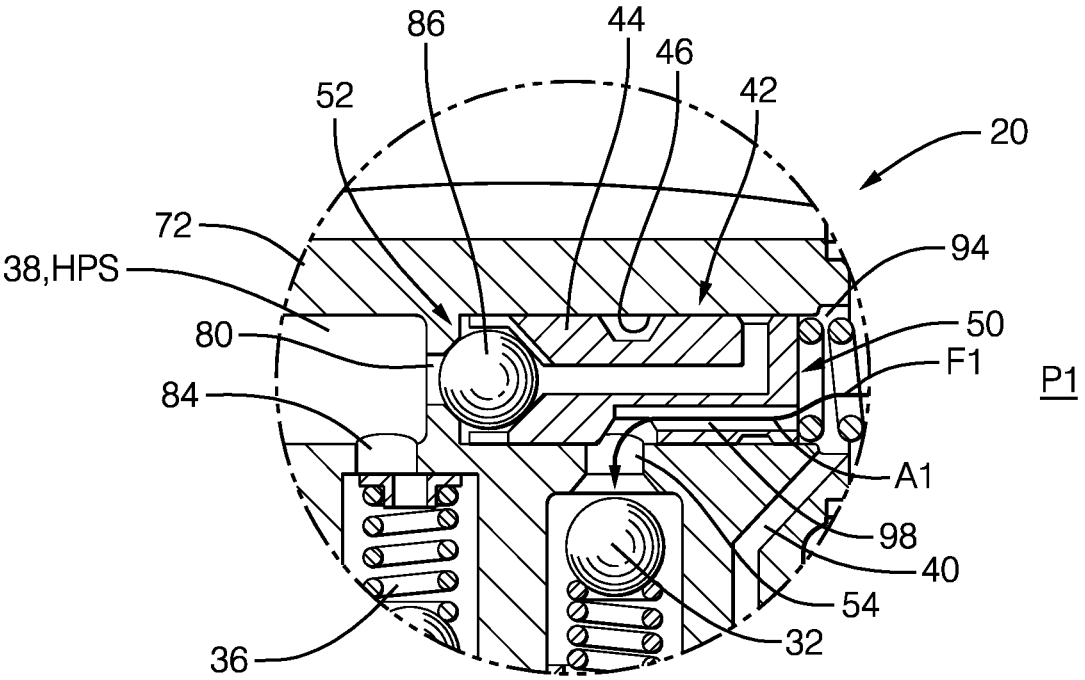
FIGS. 8 to 11 are magnified area of the pump of FIGS. 6 and 7, the figures illustrating different phase of operation of a regulation unit of the pump.

FIG. 8 illustrates the first function of the regulation unit 20, where the pressure in the high pressure space HPS is below the first pressure threshold PT1, the spool member 44 being in the first extreme position P1, the inlet fluid communication F1 is fully open, the second fluid communication F2 and the outlet fluid communication F3 are closed.

Indeed, in said position of the spool member, the inlet aperture 54 opens in the inlet groove 96 and the fuel flowing from the inlet pipe 90 to the compression chamber 28 has a non-restricted path, this is represented on the figure by the large arrow A1. Said fuel easily flows in the inner inlet channel 98 then, in the inlet groove 96, it passes the inlet aperture 54 easily pushing the ball of the inlet valve 32 to flow in the controlled inlet channel 30 prior to entering the compression chamber 28. An advantage for having the inlet groove 96 over a simple radial opening is that whatever is the angular position of the spool member 44 in the valve bore, the inlet aperture 54 always opens in said inlet groove. Consequently angular positioning of the spool member relative to the valve bore is not required. In the situation of FIG. 8, the pressure in the high pressure space HPS is not regulated, all parameters being constant.

Figure 9:
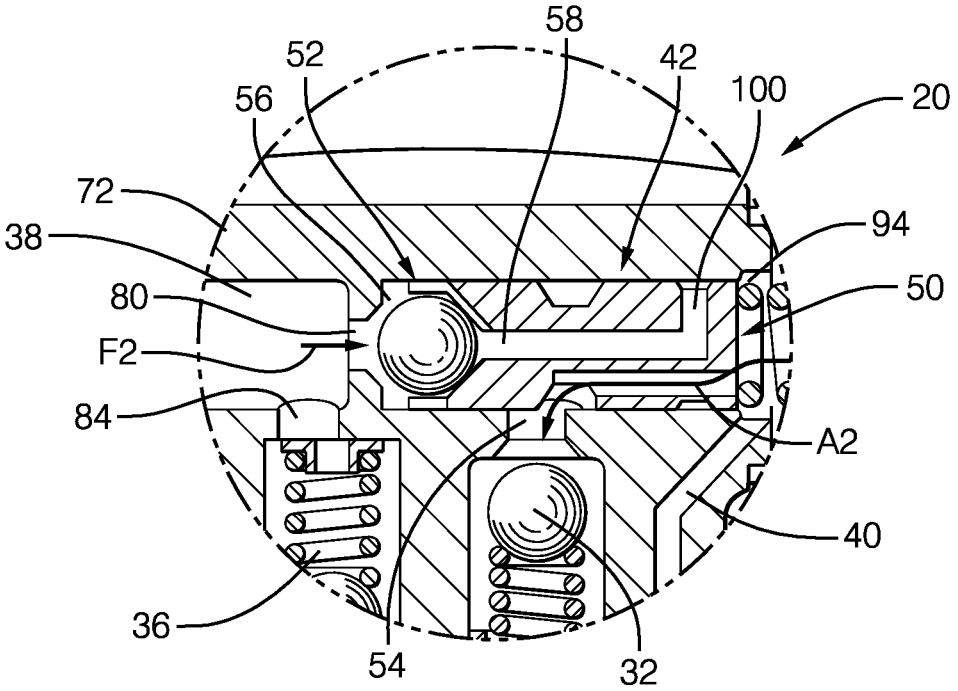

FIG. 9 illustrates the second function of the regulation unit 20, where the pressure in the high pressure space HPS is superior to the first pressure threshold PT1, within the lower sub-range OPR1, the inlet fluid communication F1 is restricted, the second fluid communication F2 is open and the outlet fluid communication F3 is closed.

Indeed, in said position of the spool member 44, the ball 86 no longer seats on the seating face 82, the relief opening 80 is open and the high pressure space HPS increases by the volume of the relief chamber 56 that is between the spool member and the relief opening 80. Also, the inlet groove 96 having also moved backward toward the inlet, the inlet aperture 54 is now partially covered and partially closed by the outer cylindrical face of the spool member, therefore the inlet path above described is restricted, this being represented on the figure by the thinner arrow A2.

Furthermore, as in the situation of FIG. 8, the rear opening 100 of the spill orifice is closed by the cylindrical face of the valve bore 46. The fuel that has entered the relief chamber 56 cannot exit, the third fluid communication F3 remaining closed.

In the situation of FIG. 9, the pressure in the high pressure space HPS is regulated by the addition of the volume of the relief chamber to the high pressure space HPS and also by, the restriction of the inlet flow. Both said addition and said restriction are continuous function dependent upon the pressure in the high pressure space HPS.

Figure 10:
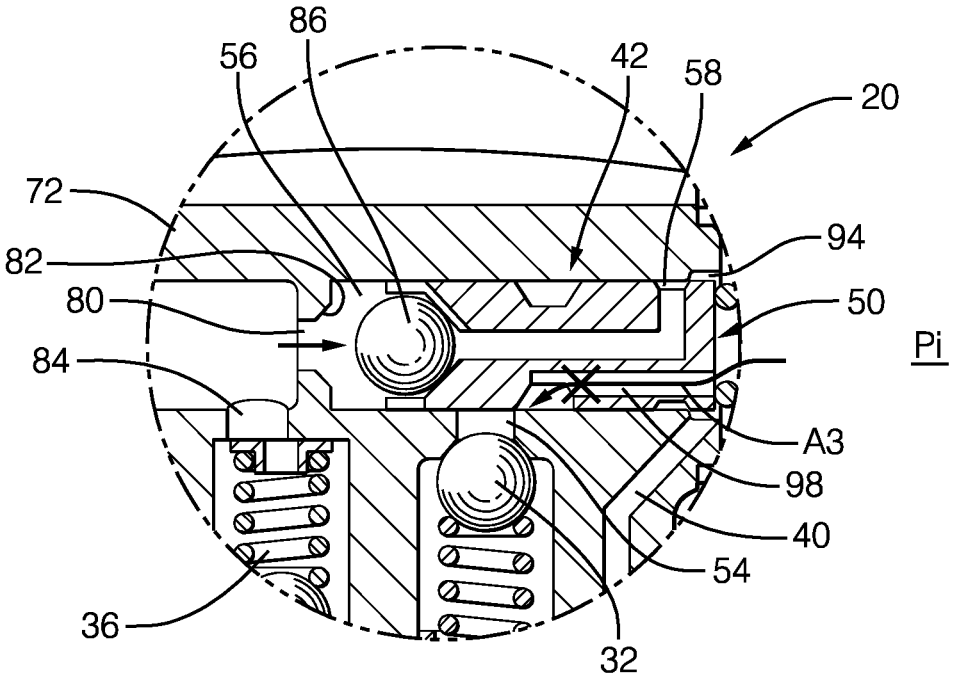

FIG. 10 illustrates the third function of the regulation unit 20, where the pressure in the high pressure space HPS has reached the intermediate pressure threshold PTi, the inlet fluid communication F1 is closed, the second fluid communication F2 is open and the outlet fluid communication F3 is closed.

Indeed, in said position of the spool member 44 has moved backward in regards of FIG. 9, the inlet groove 96 has continued to move backward and the inlet aperture 54 is now totally covered and totally closed by the outer cylindrical face of the spool member, therefore the inlet path above described is closed, this being represented by the very thin arrow A3 and the "X" marking said closure. Also the relief chamber 56 has continued to enlarge offering even more space to the high pressure space HPS.

Furthermore, as in the previous situations of FIGS. 8 and 9, the rear opening 100 of the spill orifice remains closed by the cylindrical face of the valve bore 46. The fuel in the relief chamber 56 cannot exit, the third fluid communication F3 remaining closed.

In the situation of FIG. 10, the pressure in the high pressure space HPS is regulated by the further continuous addition of the volume of the relief chamber to the high pressure space HPS and, by closing the inlet flow.

Figure 11:
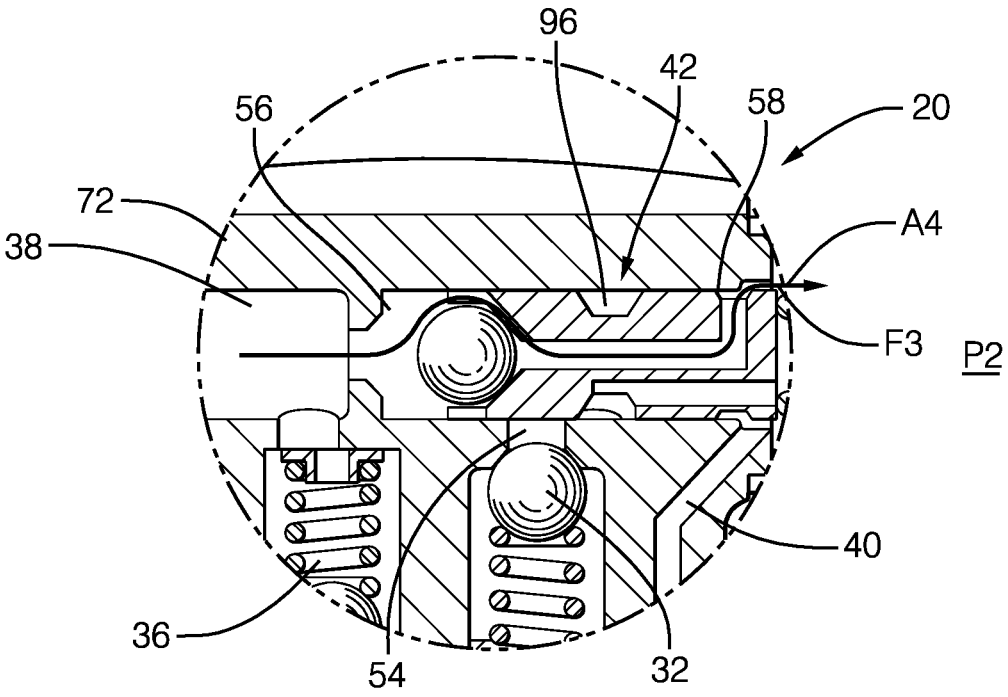
Figure 12:
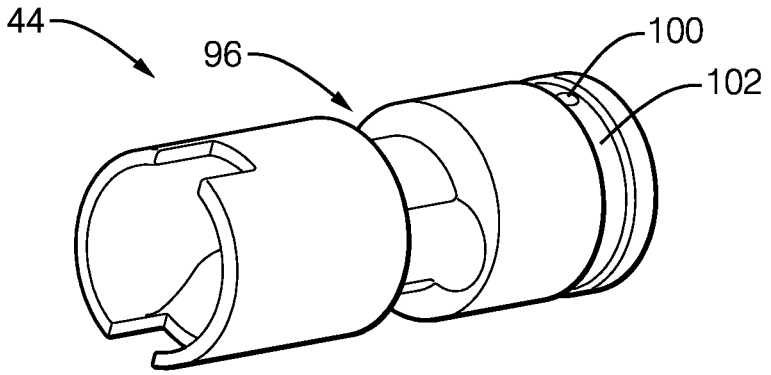
FIG. 12 to 15 are further details of a spool valve member of the regulation unit of the pump of FIGS. 6 to 11.
Figure 13:
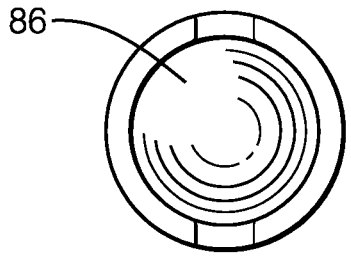
Figure 14:
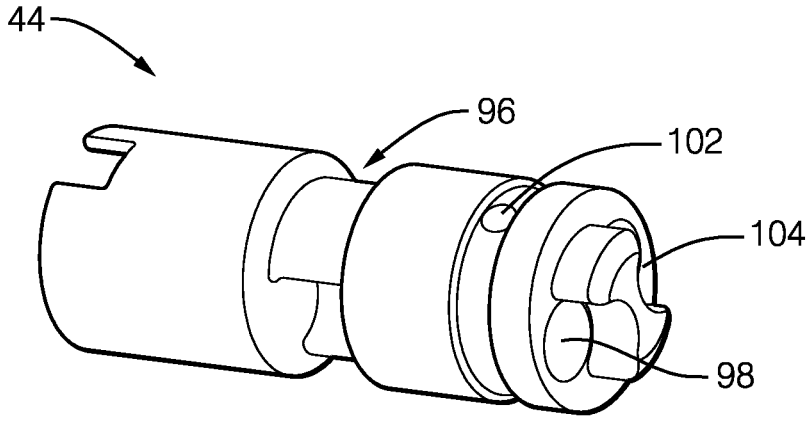
Figure 15:
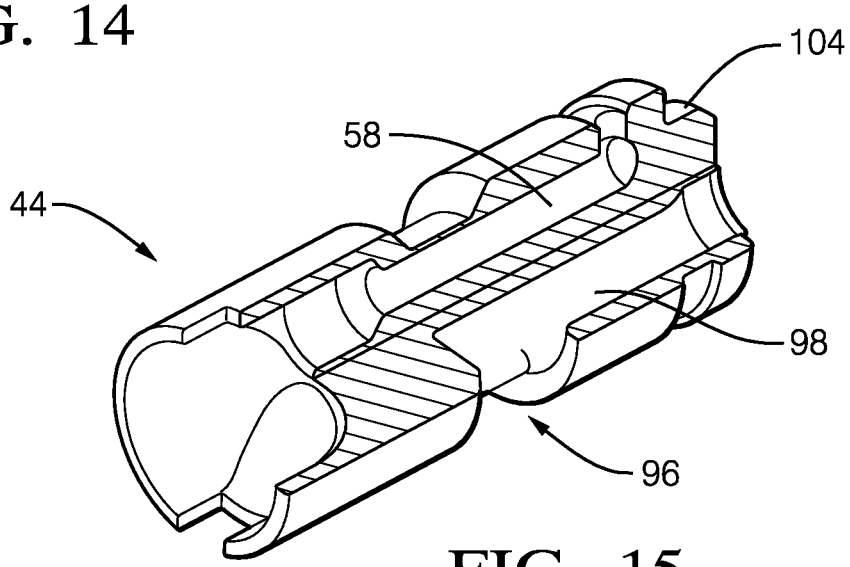

FIG. 11 illustrates the fourth function of the regulation unit 20, where the pressure in the high pressure space HPS has reached the second pressure threshold PT2, the inlet fluid communication F1 remains closed, the second fluid communication F2 is open and the outlet fluid communication F3 is now open.

Indeed, in said position of the spool member 44 has moved backward to the second extreme position P2, the inlet aperture 54 is totally covered closed by the outer cylindrical face of the spool member, the relief chamber 56 has continued to enlarge offering even more space to the high pressure space HPS and, the rear opening 100 of the spill channel 58 is now in the enlarged entry 94 of the bore which opens the spill orifice 58 and the return fluid communication F3, this being represented by arrow A4.

In the situation of FIG. 11, the pressure in the high pressure space HPS is rapidly lowered by enabling excess of fuel to return toward the low pressure inlet. This opening of the return fluid communication F3 is a safety function preventing the pressure to rise too much, especially in so called hot soak condition when, a hot engine is stopped, the heat continuing to transfer to the high pressure space HPS wherein fuel remains. Under said heat condition pressure of the fuel rises and but is limited by opening of said return fluid communication F3.

The spool member 44 of the described embodiment is further presented in the FIGS. 12 to 15 enabling to visualize the inner inlet channel 98, the spill channel 56, the ball 86, the outer cylindrical face and the inlet groove 96.

For similar advantage of non-angular orientation of the spool member in the valve bore, the rear opening 100 of the spill channel indeed opens in a spill groove 102 provided in the spool member To secure the positioning of the valve spring 48 against the inlet end 50 of the spool member, said inlet end 50 is provided with a protrusion 104 around which the last turns of the valve spring 48 engage.

LIST OF REFERENCES

X pumping axis
BDC bottom dead centre
TDC top dead centre
P1 first extreme position
P2 second extreme position
Pi intermediate position
HPS high pressure space
PT1 first pressure threshold
PT2 second pressure threshold
PTi intermediate pressure threshold
OPR operational pressure range
OPR1 lower sub-range
OPR2 higher sub-range
F1 inlet fluid communication
F2 second fluid communication
F3 return fluid communication
10 pump assembly
12 low pressure fuel tank
14 pump body
16 pump inlet
18 pump outlet
20 regulation unit
22 pressurizing unit
24 bore
26 plunger—piston
28 compression chamber
30 controlled inlet channel
32 inlet valve
34 controlled outlet channel
36 outlet valve
38 final outlet channel
40 leak return channel
42 mechanically regulated valve
44 spool valve member
46 valve bore
48 valve spring
50 inlet end of the spool member
52 outlet end of the spool member
54 inlet aperture
56 relief chamber
58 spill channel
60 pressurizing body
62 upper face of the pressurizing body
64 gallery
66 cam follower
68 lip seal
70 main valve spring
72 regulation body
74 cylindrical lateral wall
76 bottom face
78 ceiling of the compression chamber
80 opening—relief opening
82 seating face
84 aperture of the controlled outel channel
86 ball—closing member of the spool
88 annular member
90 inlet pipe
92 outlet connection member
94 enlarged entry of the bore
96 inlet groove
98 inner inlet channel
100 rear opening of the spill channel
102 spill groove
104 protrusion

The invention claimed is:

1. A self-regulated fuel pump assembly of a fuel injection system of an internal combustion engine, the fuel pump assembly being adapted to be arranged between a low pressure tank and a high pressure reservoir, the fuel pump assembly comprising:

a pump body defining an inlet fluid communication controlled by an inlet valve for enabling an inlet fuel quantity to enter a compression chamber;

a piston which varies the volume of said compression chamber and pressurizes the fuel, wherein pressurized fuel is expelled and delivered into a high pressure space, comprising the high pressure reservoir, via an outlet fluid communication controlled by an outlet valve; and a mechanical regulating valve arranged in the pump body which modulates the pressure in the high pressure space so that the pressure matches engine demand, modulation of the pressure in the high pressure space by the mechanical regulating valve requiring adjustment of the inlet fuel quantity, adjustment of the volume of the high pressure space wherein is stored the pressurized fuel and, control of a return fluid communication enabling fuel to exit the high pressure reservoir;

wherein the mechanical regulating valve comprises a spool valve member slidably arranged in a valve bore provided in the pump body, said spool valve member controlling the inlet fluid communication, the volume of the high pressure space and, the return fluid communication; and wherein the mechanical regulating valve further comprises a valve spring biasing the spool valve member toward a first extreme position where the inlet fluid communication is fully open and the return fluid communication is closed, and wherein the pressure in the high pressure space biases the spool valve member toward a second extreme position where the inlet fluid communication is closed and the return fluid communication is open, the biasing force of the spring being opposed to the biasing force of the outlet pressure.

2. A fuel pump assembly as claimed in claim 1, wherein the mechanical regulating valve is active within an operational pressure range extending between a first pressure threshold below which the inlet fluid communication is fully open and, a second pressure threshold above which opens the return fluid communication.

3. A fuel pump assembly as claimed in claim 2, wherein throughout the operational pressure range the pressure in the high pressure reservoir is adjusted to match the engine demand by adjusting the volume of the high pressure space as a function of the pressure in said high pressure space.

4. A fuel pump assembly as claimed in claim 3, wherein when the pressure in the high pressure space is within a lower sub-range closer to the first pressure threshold of the operational pressure range, the pressure in the high pressure reservoir is further adjusted to the engine demand by restricting the inlet fluid communication thus decreasing the inlet quantity of fuel entering in the compression chamber.

5. A fuel pump assembly as claimed in claim 4, wherein the inlet fluid communication is continuously varied within said lower sub-range.

6. A fuel pump assembly as claimed in claim 5, wherein when the pressure in the high pressure space is within a higher sub-range closer to the second pressure threshold of the operational pressure range, the pressure in the high pressure reservoir is further adjusted to match the engine demand by closing the inlet fluid communication thus preventing fuel entry in the compression chamber.

7. A fuel pump assembly as claimed in claim 6, wherein the lower sub-range extends from the first pressure threshold to an intermediate pressure threshold and, the higher sub-range extends from said intermediate pressure threshold to the second pressure threshold.

8. A fuel pump assembly as claimed in claim 1, wherein the spool valve member has a cylindrical lateral face extending from a front end to a back end, said front end being provided with a closing member adapted to sealingly seat against a seating face of the pump body, said seating face surrounding a relief opening of the return fluid communication and wherein, when the spool valve member is in the first extreme position the closing member sealingly seats on the seating face closing said relief opening.

9. A fuel pump assembly as claimed in claim 8, wherein the return fluid communication is further provided with a rear opening defined at an end of a spill channel arranged in the spool valve member an opening entry of said spill channel being in the front end of the spool valve member, in close vicinity to the closing member and wherein said rear opening only opens when the spool valve member is in the second extreme position enabling fuel to return from a relief chamber to the low pressure inlet.

10. A fuel pump assembly as claimed in claim 9, wherein the end of said spill channel opens in a lateral face of the spool valve member, the relief opening of said end being closed by a face of the valve bore against which complementary slides the lateral face of the spool valve member and wherein, the rear opening of the return fluid communication only opens when the spool valve member is in the second extreme position, the rear end of the spill channel facing the relief opening.

11. A fuel pump assembly as claimed in claim 8, wherein the spool valve member further comprises an inner inlet channel extending inside the spool valve member from the back end toward the relief opening and wherein a controlled inlet channel in which the inlet valve is located opens at one end in the compression chamber and, at an opposite end in a face of the valve bore via an inlet aperture, the inlet fluid communication being open when an opening of the inner inlet channel faces said inlet aperture.

12. A fuel pump assembly as claimed in claim 11, wherein said opening of the inner inlet channel is defined in an annular inlet groove provided in the lateral face of the spool valve member and wherein when being in the first extreme position of the spool valve member, the inlet aperture faces said annular inlet groove.

13. A fuel pump assembly as claimed in claim 12, wherein when the pressure in the high pressure space varies within the lower sub-range of the operational pressure range, the spool valve member slides in the valve bore, the cylindrical lateral face of the spool member partially covering the inlet aperture of the controlled inlet channel, restricting the inlet fluid communication.

14. A fuel pump assembly as claimed in claim 13, wherein when the pressure in the high pressure space increases within the higher sub-range of the operational pressure range, the spool valve member slides in the valve bore such that the cylindrical lateral face totally covers the inlet aperture of the controlled inlet channel, thus closing the inlet fluid communication.

15. A fuel pump assembly as claimed in claim 14, wherein when the pressure in the high pressure space rises, the volume of the high pressure space increases by the additional space of a relief chamber comprised between the front end of the spool valve member and the seating face of the pump body.

16. A fuel pump assembly as claimed in claim 1, wherein the inlet valve is a one-way check valve forbidding fuel pressurized in the compression chamber to flow back toward the inlet fluid communication and wherein the outlet valve is another one-way check valve forbidding high pressure fuel contained in the high pressure space to flow back to the compression chamber.

* * * * *